US011854736B2

(12) United States Patent
Yang et al.

(10) Patent No.: US 11,854,736 B2
(45) Date of Patent: Dec. 26, 2023

(54) METHOD OF PREPARING A HIGH-COERCIVITY SINTERED NDFEB MAGNET

(71) Applicant: Yantai Dongxing Magnetic Materials Inc., Shandong (CN)

(72) Inventors: Kunkun Yang, Shandong (CN); Chuanshen Wang, Shandong (CN); Zhongjie Peng, Shandong (CN); Kaihong Ding, Shandong (CN)

(73) Assignee: Yantai Dongxing Magnetic Materials Inc., Shandong (CN)

( * ) Notice: Subject to any disclaimer, the term of this patent is extended or adjusted under 35 U.S.C. 154(b) by 55 days.

(21) Appl. No.: 17/575,665

(22) Filed: Jan. 14, 2022

(65) Prior Publication Data

US 2022/0230805 A1 Jul. 21, 2022

(30) Foreign Application Priority Data

Jan. 15, 2021 (CN) ..... 202110052347.0

(51) Int. Cl.

| | |
|---|---|
| ***H01F 41/02*** | (2006.01) |
| ***B22F 1/17*** | (2022.01) |
| ***B22F 3/16*** | (2006.01) |
| ***B22F 3/24*** | (2006.01) |
| ***C22C 38/14*** | (2006.01) |
| ***C22C 38/06*** | (2006.01) |

(Continued)

(52) U.S. Cl.

CPC ..... *H01F 41/0266* (2013.01); *B22F 1/17* (2022.01); *B22F 3/16* (2013.01); *B22F 3/24* (2013.01); *C22C 38/005* (2013.01); *C22C 38/06* (2013.01); *C22C 38/10* (2013.01); *C22C 38/14* (2013.01); *C22C 38/16* (2013.01); *B22F 2003/248* (2013.01); *B22F 2301/355* (2013.01); *B22F 2304/10* (2013.01); *C22C 2202/02* (2013.01); *H01F 1/0577* (2013.01)

(58) Field of Classification Search

None

See application file for complete search history.

(56) References Cited

FOREIGN PATENT DOCUMENTS

| | | | |
|---|---|---|---|
| CA | 2023924 | A1 | 6/1991 |
| CN | 101525443 | A | 9/2009 |

(Continued)

*Primary Examiner* — Anthony M Liang

(74) *Attorney, Agent, or Firm* — Gang Yu

(57) ABSTRACT

The present disclosure provides a method for preparing a high-coercivity sintered NdFeB magnet. The method including the steps of:

S1, Providing a NdFeB powder as a main material;

S2, Vacuum coating a layer of a rare earth alloy $R_xH_{(100-x)}$ on a surface of a metal nano-powder M to obtain an auxiliary alloy material with a core-shell structure, with R being selected from one or more of Dy, Tb, Pr, Nd, La, and Ce; H being selected from one or more of Cu, Al, and Ga; the nano-powder M being selected from one or more of Mo, W, Zr, Ti, and Nb; $0 \leq x \leq 90$ wt. %;

S3, Adding the auxiliary alloy material obtained by step S2 to the NdFeB powder of step S1 and mixing, then orientation pressing of the mixture to obtain a compact body; and S4, Sintering and annealing treatment of the compact body to obtain the high-coercivity sintered NdFeB magnet.

17 Claims, 1 Drawing Sheet

(51) Int. Cl.

| | |
|---|---|
| ***C22C 38/16*** | (2006.01) |
| ***C22C 38/00*** | (2006.01) |
| ***C22C 38/10*** | (2006.01) |
| *H01F 1/057* | (2006.01) |

(56) References Cited

FOREIGN PATENT DOCUMENTS

| | | | | | |
|---|---|---|---|---|---|
| CN | 102568809 | A | | 7/2012 | |
| CN | 103093912 | A | | 5/2013 | |
| CN | 103106991 | A | | 5/2013 | |
| CN | 103219145 | A | | 7/2013 | |
| CN | 105225782 | A | | 1/2016 | |
| CN | 110911077 | A | | 3/2020 | |
| CN | 111210963 | A | | 5/2020 | |
| CN | 111834118 | A | | 10/2020 | |
| CN | 111916285 | A | | 11/2020 | |
| EP | 0583041 | | * | 2/1994 | ..... H01F 1/053 |
| JP | 106267722 | A | | 9/1994 | |
| JP | 2015230978 | A | | 12/2015 | |

* cited by examiner

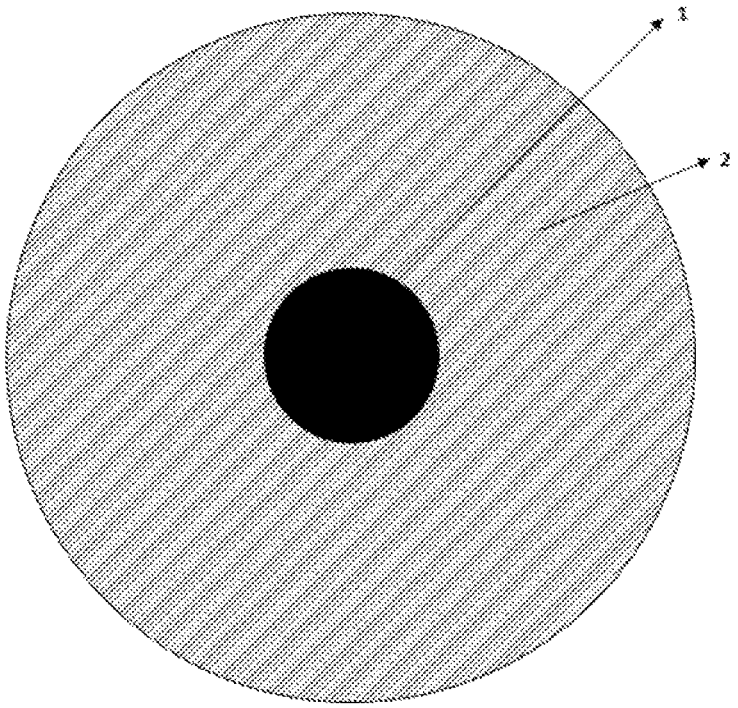
1
2

METHOD OF PREPARING A HIGH-COERCIVITY SINTERED NDFEB MAGNET

CROSS-REFERENCE TO RELATED APPLICATIONS

This application is based on Chinese Patent Application No. 202110052347.0, filed on Jan. 15, 2021, which claims the benefit of priority to the Chinese Patent Application, which is incorporated by reference in its entirety herein.

BACKGROUND OF THE DISCLOSURE

Field of the Disclosure

The disclosure relates to a technique for preparing rare earth permanent magnet materials and magnets, in particular to a method of preparing a high-coercivity sintered NdFeB magnet.

Description of the Prior Art

NdFeB permanent magnets are an important rare earth application in several technical fields and their use is permanently increasing. Accordingly, the demand for high-performance NdFeB permanent magnet materials raises significantly. The coercivity of the sintered NdFeB magnets is a very important magnetic parameter and a sensitive parameter of the organizational structure. It is mainly affected by the HA of the main phase grains of the magnet and the grain boundary between the main phase grains. The greater the HA, the greater is the final coercive force of the magnet, and the wider and more continuous the grain boundary between the main phase grains, the higher is the coercive force of the magnet.

According to the conventional dual alloy method, a rare earth auxiliary alloy is added to the NdFeB powder, and then undergoes orientation pressing, sintering and aging. During the sintering and aging process, the diffusion flow of the auxiliary alloy at the grain boundary reaches the hardened NdFeB magnet grains, expands the width of the grain boundary to optimize the grain boundary structure, thereby improving the coercivity of the NdFeB magnet. For example, CN108389711A discloses the use of NdFeB magnet powder as the main alloy material, and a rare earth Dy/Tb-Cu/Al/Ni alloy powder as an auxiliary alloy material for preparing high remanence and high coercivity sintered NdFeB magnets.

However, using the dual alloy technology, as the grain boundary phases flow and migrate during the sintering process, the grains of the different NdFeB main phases may still be in contact, resulting in the growth of the grains and the destruction of the continuity of the grain boundary phases. This makes the grain boundary phases unable to completely split the main phase crystal grains, causing only a small increase in the coercivity of the NdFeB magnet.

CN102237166A discloses the addition of a nano-silicon carbide powder to a NdFeB alloy powder, orientation molding of the mixture to a compact body, then sintering and aging the compact body to obtain a high-coercivity sintered NdFeB magnet. CN105321699A discloses adding a nano-tungsten powder to the NdFeB powder during the preparation process of high-coercivity sintered NdFeB magnets. The mentioned auxiliary alloy nano-powders have a high melting point and prevent abnormal growth of crystal grains during the sintering process at the grain boundary. However, the size difference between the nano-powder as the auxiliary alloy and the micron-sized NdFeB magnetic powder in the above-mentioned patent is large, and the agglomeration of the nanosized powder is serious, so it is difficult to mix and stir the mixture uniformly with the NdFeB powder, resulting in the NdFeB magnets have uneven distribution of auxiliary alloy components and large deviations in magnetic properties. In addition, the enrichment of high melting point auxiliary alloy nanosized powders expands the grain boundaries but no new grain boundary phases are added, resulting in easy formation of voids at the grain boundaries. Thereby, the corrosion resistance and mechanical properties of neodymium iron boron magnets are deteriorated.

SUMMARY OF THE DISCLOSURE

The present disclosure provides a method of adding the new core-shell structure auxiliary alloy to improve the coercivity of the NdFeB magnet. Specifically, the present disclosure provides a method for preparing a high-coercivity sintered NdFeB magnet as defined in claim 1. Preferred embodiments could be learned from the dependent claims or the following description.

BRIEF DESCRIPTION OF THE DRAWINGS

FIG. 1 is a schematically cross-sectional view through the core-shell structure of the auxiliary alloy material. In FIG. 1, 1 denotes a core material, 2 denotes a shell material.

DETAILED DESCRIPTION OF THE EMBODIMENTS

The principles and features of the present disclosure will be described below, and the examples given are only used to explain the present disclosure.

In order to solve the difficulty of forming a uniform, continuous mesh inside the NdFeB magnet by the traditional double alloy method grain boundary phase structure, which leads to the problem that the coercive force of NdFeB magnets is relatively low. The present application provides a method for improving the coercivity of NdFeB magnets by adding a new core-shell structure auxiliary alloy.

The present disclosure provides a method for preparing a high-coercivity sintered NdFeB magnet. The method includes the steps of:

S1, Providing a NdFeB powder as a main material;

S2, Vacuum coating a layer of a rare earth alloy $R_xH_{(100-x)}$ on a surface of a metal nano-powder M to obtain an auxiliary alloy material with a core-shell structure, wherein R includes, but is not limited to, one or more of a group consisting of Dy, Tb, Pr, Nd, La, and Ce; H includes, but is not limited to, one or more of a group consisting of Cu, Al, and Ga; M includes, but is not limited to, one or more of a group consisting of Mo, W, Zr, Ti, and Nb; $30 \leq x \leq 90$ wt. %, preferably $40 \leq x \leq 85$ wt. %;

S3, Adding the auxiliary alloy material obtained by step S2 to the NdFeB powder of step (S1) and mixing, then orientation pressing of the mixture to obtain a compact body; and S4, Sintering and annealing treatment of the compact body to obtain the high-coercivity sintered NdFeB magnet.

In one preferred implementation, in the rare earth alloy $R_xH_{(100-x)}$, H includes, but is not limited to, one or more of a group consisting of Cu, Ga, AlCu, or AlGa. In addition or in alternative, R includes, but is not limited to, one or more of a group consisting of Dy, Ce, Nd, PrNd or PrDy. Examples of rare earth alloys $R_xH_{(100-x)}$ include $Dy_{70}Cu_{30}$ (i.e. 70 wt. % Dy and 30 wt. % Cu), $Pr_{60}Nd_{10}Al_{20}Cu_{10}$, $Pr_{65}Dy_{20}Ga_{15}$, $Nd_{80}Al_{10}Ga_{10}$, and $Ce_{40}Cu_{60}$.

In one preferred implementation, the metal nano-powder M includes, but is not limited to, one or more of a group consisting of Mo, W, Zr, and Nb.

In one preferred implementation, the rare earth alloy $R_xH_{(100-x)}$ has a lower melting point than the metal nano-powder M.

In one preferred implementation, the NdFeB powder, which is provided in step S1, is composed of $RE_aFe_{(1-abc)}B_bT_c$, in which RE includes, but is not limited to, one or more of a group consisting of Nd, Pr, La, Ce, Dy, Tb, and Ho; Fe is iron (forming the balance); B is boron; T includes, but is not limited to, one or more of a group consisting of Al, Cu, Co, Ga, Zr, Nb, Mn, and Ti; and $28 \leq a \leq 32$ wt. %, $0.8 \leq b \leq 1.2$ wt. %, $0 \leq c \leq 5$ wt. %.

In one preferred implementation, an average particle size of the NdFeB powder is 1 to 10 μm, in particular 2 to 6 μm, measured by laser diffraction. The average particle diameter (D50) of the particles may be measured by laser diffraction (LD). The method may be performed according to ISO 13320. The equivalent diameter of a non-spherical particle is equal to a diameter of a spherical particle that exhibits identical properties to that of the investigated non-spherical particle.

In another preferred implementation, which could be combined with any of the preceding embodiments, an average particle size (D50) of the metal nano-powder M is 1 to 1000 nm, more preferably 3 to 500 nm, specifically 5 to 200 nm. The average particle diameter (D50) of the particles may be measured by dynamic light scattering (DLS). The method may be performed according to ISO 22412. A mean particle size result of polydisperse samples is determined by peak analysis of the particle size distribution graph. The median D50 is the value separating the higher half of the data from the lower half. It is the determined particle size from which half of the particles are smaller and half are larger.

In one preferred implementation, a weight ratio of the rare earth alloy $R_xH_{(100-x)}$ to the metal nano-powder M in the auxiliary alloy material with a core-shell structure is in the range of 1:(1~20).

In one preferred implementation, a weight ratio of the auxiliary alloy material to the NdFeB powder is in the range of 1:(20~1000) in step S3.

In one preferred implementation, it is further preferred that a sintering temperature in step S4 is 950 to 1100° C. and a sintering time in step S4 is 6 to 12 h.

In one preferred implementation, the annealing treatment in step S4 may include a primary annealing treatment and a secondary annealing treatment. The temperature of the primary annealing treatment may be in the range of 800 to 900° C. for 3 to 15 h and the temperature of the secondary annealing treatment is in the range of 450 to 650° C. for 3 to 10 h.

According to the present disclosure, an auxiliary alloy material with a core-shell structure is added to the NdFeB magnetic powder. The auxiliary alloy material has a core of a high melting metal nano-powder that prevents during the sintering process the crystal grains of different main phases from contacting and growing. In addition, the core at the grain boundary promotes the flow and diffusion of the rare earth alloy shell melt of the auxiliary alloy at the grain boundary during the sintering and aging process, broadens the grain boundary phase, and hardens the NdFeB magnet grains. Furthermore, the coercive force of the sintered NdFeB magnet is greatly improved. Compared with the traditional auxiliary alloy material having a non-core-shell structure, the coercive force of the NdFeB magnet prepared by the disclosure is higher.

FIG. 1 shows in a schematic cross-sectional view a cut through a single particle of an auxiliary alloy material used for the present preparation method of sintered NdFeB magnets. The auxiliary alloy material has the core-shell structure with a core 1 made of a metal nano-powder M and a layer 2 of a rare earth alloy $R_xH_{(100-x)}$ disposed on the surface of the core 1 by vacuum deposition.

Implementing Example 1

A method of preparing a high-coercivity sintered NdFeB magnet, includes:

Step S1: Alloy flakes with the composition $(PrNd)_{32}Co_1Al_{0.38}Cu_{0.1}Ti_{0.15}B_{1.0}Fe$(balance) are prepared by smelting, and then subjected to hydrogen decrepitation crushing and then placed in a jet mill for further crushing to produce a main alloy powder with an average particle size (D50) of 2 μm.

Step S2: Mo powder with an average particle size of 5 nm is taken as core material and a vacuum coating method is used to coat a layer of $Dy_{70}Cu_{30}$ (shell material 2) alloy on the Mo powder. The weight ratio of the alloy forming the shell to the core material is 1:10 in the obtained auxiliary alloy material.

Step S3: The auxiliary alloy is added to the main alloy at a percentage ratio of 0.5 wt. % and the main alloy and the auxiliary alloy are mixed. After that, the mixture is oriented and formed in a 1.8 T magnetic field, and then subjected to 180 MPa cold isostatic pressing to form a compact body.

Step S4: The compact body is vacuum sintered at 950° C. for 12 h, then subjected to a primary annealing treatment at 850° C. primary tempering for 6 h, and subjected to a secondary annealing treatment at a secondary tempering of 500° C. for 5 h, then abtain the sintered NdFeB magnet.

Comparative Example 1

Steps S1 through S4 are performed in the same manner as in Example 1 except the following:

In step S2, $Dy_{70}Cu_{30}$ alloy powder with the same average particle size as the auxiliary alloy in Example 1 is added to the main alloy powder.

Comparative Example 1 uses a common auxiliary alloy material, whereas Example 1 uses a core-shell structure auxiliary alloy material. After cutting the sintered NdFeB magnets, their magnetic properties were tested (tested temperature 20±3° C.), and the test results were recorded in Table 1.

TABLE 1

| Sample | Br(T) | Hcj(KA/m) | Hk/Hcj |
|---|---|---|---|
| Example 1 | 1.362 | 1576 | 0.98 |
| Comparative Example 1 | 1.36 | 1378 | 0.98 |

It can be seen from Table 1 that the coercive force of the NdFeB magnet prepared by adding the $Dy_{70}Cu_{30}$ alloy with core-shell structure to the NdFeB alloy powder in Example 1 increases by 198 KA/m compared with the addition of ordinary $Dy_{70}Cu_{30}$ alloy.

Implementing Example 1

A method of preparing a high-coercivity sintered NdFeB magnet, includes:

Step S1: Alloy flakes with the composition $Nd_{30}Co_{0.9}Al_{0.75}Cu_{0.1}Ti_{0.15}B_{0.9}Fe$(balance) are prepared by smelting, and then subjected to hydrogen decrepitation crushing and then placed in a jet mill for further crushing to produce a main alloy powder with an average particle size (D50) of 4 μm.

Step S2: W powder with an average particle size of 50 nm is taken as core material and a vacuum coating method is used to coat a layer of $Pr_{60}Nd_{10}Al_{20}Cu_{10}$ (shell material 2) alloy on the W powder. The weight ratio of the alloy forming the shell to the core material is 1:20 in the obtained auxiliary alloy material.

Step S3: The auxiliary alloy is added to the main alloy at a percentage ratio of 5 wt. % and the main alloy and the auxiliary alloy are mixed uniformly. After that, the mixture is oriented and formed in a 1.8 T magnetic field, and then subjected to 180 MPa cold isostatic pressing to form a compact body.

Step S4: The compact body is vacuum sintered at 1000° C. for 10 h, then subjected to a primary annealing treatment at 850° C. primary tempering for 6 h, and subjected to a secondary annealing treatment at a secondary tempering of 500° C. for 5 h, then abtain the sintered NdFeB magnet.

Comparative Example 2

Steps S1 through S4 are performed in the same manner as in Example 2 except the following:

In step S2 $Pr_6(Nd_{10}Al_{20}Cu_{10}$ alloy powder with the same average particle size as the auxiliary alloy in Example 2 is added to the main alloy powder.

Comparative Example 2 uses a common auxiliary alloy material, whereas Example 2 uses a core-shell structure auxiliary alloy material. After cutting the sintered NdFeB magnets, their magnetic properties were tested (tested temperature 20±3° C.), and the test results were recorded in Table 2.

TABLE 2

| Sample | Br(T) | Hcj(KA/m) | Hk/Hcj |
|---|---|---|---|
| Example 2 | 1.379 | 1600 | 0.97 |
| Comparative Example 2 | 1.38 | 1377 | 0.97 |

It can be seen from Table 2 that the coercive force of the NdFeB magnet prepared by adding the $Pr_{60}Nd_{10}Al_{20}Cu_{10}$ alloy with core-shell structure to the NdFeB alloy powder in Example 2 increases by 223 KA/m compared with the addition of ordinary $Pr_{60}Nd_{10}Al_{20}Cu_{10}$ alloy.

Implementing Example 3

A method of preparing a high-coercivity sintered NdFeB magnet, includes:

Step S1: Alloy flakes with the composition $(PrNd)_{29.5}Co_1Ga_{0.2}Cu_{0.1}Ti_{0.15}B_{1.0}Fe$ (balance) are prepared by smelting, and then subjected to hydrogen decrepitation crushing and then placed in a jet mill for further crushing to produce a main alloy powder with an average particle size (D50) of 4 μm.

Step S2: Nb powder with an average particle size of 100 nm is taken as core material and a vacuum coating method is used to coat a layer of $Pr_{65}Dy_{20}Ga_{15}$ (shell material 2) alloy on the Nb powder. The weight ratio of the alloy forming the shell to the core material is 1:5 in the obtained auxiliary alloy material.

Step S3: The auxiliary alloy is added to the main alloy at a percentage ratio of 1.0 wt. % and the main alloy and the auxiliary alloy are mixed uniformly. After that, the mixture is oriented and formed in a 1.8 T magnetic field, and then subjected to 180 MPa cold isostatic pressing to form a compact body.

Step S4: The compact body is vacuum sintered at 1100° C. for 6 h, then subjected to a primary annealing treatment at 850° C. primary tempering for 6 h, and subjected to a secondary annealing treatment at a secondary tempering of 500° C. for 5 h, then abtain the sintered NdFeB magnet.

Comparative Example 3

Steps S1 through S4 are performed in the same manner as in Example 3 except the following:

In step S2, $Pr_{65}Dy_{20}Ga_{15}$ alloy powder with the same average particle size as the auxiliary alloy in Example 3 is added to the main alloy powder.

Comparative Example 3 uses a common auxiliary alloy material, whereas Example 3 uses a core-shell structure auxiliary alloy material. After cutting the sintered NdFeB magnets, their magnetic properties were tested (tested temperature 20±3° C.), and the test results were recorded in Table 3.

TABLE 3

| Sample | Br(T) | Hcj(KA/m) | Hk/Hcj |
|---|---|---|---|
| Example 3 | 1.446 | 1377 | 0.97 |
| Comparative Example 3 | 1.448 | 1210 | 0.98 |

It can be seen from Table 3 that the coercive force of the NdFeB magnet prepared by adding the $Pr_{65}Dy_{20}Ga_{15}$ alloy with core-shell structure to the NdFeB alloy powder in Example 3 increases by 167 KA/m compared with the addition of ordinary $Pr_{65}Dy_{20}Ga_{15}$ alloy.

Implementing Example 4

A method of preparing a high-coercivity sintered NdFeB magnet, includes:

Step S1: Alloy flakes with the composition $(PrNd)_{31}Co_1Tb_{1.1}Al_{0.2}Ga_{0.3}Cu_{0.1}Ti_{0.15}B_{1.0}Fe$ (balance) are prepared by smelting, and then subjected to hydrogen decrepitation crushing and then placed in a jet mill for further crushing to produce a main alloy powder with an average particle size (D50) of 6 μm.

Step S2: Zr powder with an average particle size of 200 nm is taken as core material and a vacuum coating method is used to coat a layer of $Nd_{80}Al_{10}Ga_{10}$ (shell material 2) alloy on the Zr powder. The weight ratio of the alloy forming the shell to the core material is 1:1 in the obtained auxiliary alloy material.

Step S3: The auxiliary alloy is added to the main alloy at a percentage ratio of 4.0 wt. % and the main alloy and the auxiliary alloy are mixed uniformly. After that, the mixture is oriented and formed in a 1.8 T magnetic field, and then subjected to 180 MPa cold isostatic pressing to form a compact body.

Step S4: The compact body is vacuum sintered at 1000° C. for 10 h, then subjected to a primary annealing treatment at 850° C. primary tempering for 6 h, and subjected to a secondary annealing treatment at a secondary tempering of 500° C. for 5 h, then abtain the sintered NdFeB magnet.

Comparative Example 4

Steps S1 through S4 are performed in the same manner as in Example 4 except the following:

In step S2, $Nd_{80}Al_{10}Ga_{10}$ alloy powder with the same average particle size as the auxiliary alloy in Example 4 is added to the main alloy powder.

Comparative Example 4 uses a common auxiliary alloy material, whereas Example 4 uses a core-shell structure auxiliary alloy material. After cutting the sintered NdFeB magnets, their magnetic properties were tested (tested temperature 20±3° C.), and the test results were recorded in Table 4.

TABLE 4

| Sample | Br(T) | Hcj(KA/m) | Hk/Hcj |
|---|---|---|---|
| Example 4 | 1.352 | 1823 | 0.97 |
| Comparative Example 4 | 1.355 | 1616 | 0.98 |

It can be seen from Table 4 that the coercive force of the NdFeB magnet prepared by adding the $Nd_{80}Al_{10}Ga_{10}$ alloy with core-shell structure to the NdFeB alloy powder in Example 4 increases by 207 KA/m compared with the addition of ordinary $Nd_{80}Al_{10}Ga_{10}$ alloy.

Implementing Example 5

A method of preparing a high-coercivity sintered NdFeB magnet, includes:

Step S1: Alloy flakes with the composition $(PrNd)_{31}Co_{1.0}Dy_{0.5}Al_{0.1}Ga_{0.25}Cu_{0.1}Ho_{0.1}B_{0.9}Fe$(balance) are prepared by smelting, and then subjected to hydrogen decrepitation crushing and then placed in a jet mill for further crushing to produce a main alloy powder with an average particle size (D50) of 5 μm.

Step S2: W powder with an average particle size of 20 nm is taken as core material and a vacuum coating method is used to coat a layer of $Ce_{40}Cu_{60}$ alloy on the W powder. The volume ratio of the alloy forming the shell to the core material is 1:10 in the obtained auxiliary alloy material.

Step S3: The auxiliary alloy is added to the main alloy at a percentage ratio of 0.1 wt. % and the main alloy and the auxiliary alloy are mixed uniformly. After that, the mixture is oriented and formed in a 1.8 T magnetic field, and then subjected to 180 MPa cold isostatic pressing to form a compact body.

Step S4: The compact body is vacuum sintered at 1000° C. for 10 h, then subjected to a primary annealing treatment at 850° C. for 6 h, and subjected to a secondary annealing treatment at a secondary tempering of 500° C. secondary tempering for 5 h, then abtain the sintered NdFeB magnet.

Comparative Example 5

Steps S1 through S4 are performed in the same manner as in Example 5 except the following:

In step S2, $Ce_{40}Cu_{60}$ alloy powder with the same average particle size as the auxiliary alloy in Example 5 is added to the main alloy powder.

Comparative Example 5 uses a common auxiliary alloy material, whereas Example 5 uses a core-shell structure auxiliary alloy material. After cutting the sintered NdFeB magnets, their magnetic properties were tested (tested temperature 20±3° C.), and the test results were recorded in Table 5.

TABLE 5

| Sample | Br(T) | Hcj(KA/m) | Hk/Hcj |
|---|---|---|---|
| Example 5 | 1.378 | 1504 | 0.97 |
| Comparative Example 5 | 1.38 | 1377 | 0.98 |

It can be seen from Table 5 that the coercive force of the NdFeB magnet prepared by adding the $Ce_{40}Cu_{60}$ alloy with core-shell structure to the NdFeB alloy powder in Example 5 increases by 127 KA/m compared with the addition of ordinary $Ce_{40}Cu_{60}$ alloy. The effect is obvious.

What is claimed is:

1. A method of preparing a sintered NdFeB magnet including the steps of:

S1, providing a NdFeB powder as a main material;

S2, vacuum coating a layer of a rare earth alloy $R_xH_{(100-x)}$ on a surface of a metal nano-powder M to obtain an auxiliary alloy material with a core-shell structure, with R being selected from one or more of a group consisting of Dy, Tb, Pr, Nd, La, and Ce; H being selected from one or more of a group consisting of Cu, Al, and Ga;

the metal nano-powder M being selected from one or more of a group consisting of Mo, W, Zr, Ti, and Nb; $30 \leq x \leq 90$ wt. %;

S3, adding the auxiliary alloy material obtained by step S2 to the NdFeB powder of step S1 and mixing, then orientation pressing of the mixture to obtain a compact body; and S4, sintering and annealing treatment of the compact body to obtain the sintered NdFeB magnet.

2. The method of preparing a sintered NdFeB magnet according to claim 1, wherein the NdFeB powder of step S1 is composed of $RE_aFe_{(1-a-b-c)}B_bT_c$, in which RE is selected from one or more of a group consisting of Nd, Pr, La, Ce, Dy, Tb, and Ho, Fe being iron, B being boron, T being at least one metal selected from the group of Al, Cu, Co, Ga, Zr, Nb, Mn, and Ti, and a, b, and c being $28 \leq a \leq 32$ wt. %, $0.8 \leq b \leq 1.2$ wt. %, and $0 \leq c \leq 5$ wt. %.

3. The method of preparing a sintered NdFeB magnet according to claim 1, wherein an average particle size of the NdFeB powder is 1 to 10 μm measured by laser diffraction.

4. The method of preparing a sintered NdFeB magnet according to claim 2, wherein an average particle size of the NdFeB powder is 1 to 10 μm measured by laser diffraction.

5. The method of preparing a sintered NdFeB magnet according to claim 1, wherein an average particle size of the metal nano-powder M is 0.5 to 1000 nm measured by dynamic light scattering.

6. The method of preparing a sintered NdFeB magnet according to claim 1, wherein the rare earth alloy $R_xH_{(100-x)}$ has a lower melting point than the metal nano-powder M.

7. The method of preparing a sintered NdFeB magnet according to claim 2, wherein the rare earth alloy $R_xH_{(100-x)}$ has a lower melting point than the metal nano-powder M.

8. The method of preparing a sintered NdFeB magnet according to claim 1, wherein a weight ratio of the rare earth alloy $R_xH_{(100-x)}$ to the metal nano-powder M in the auxiliary alloy material with a core-shell structure is in the range of 1:1 to 1:20.

9. The method of preparing a sintered NdFeB magnet according to claim 2, wherein a weight ratio of the rare earth alloy $R_xH_{(100-x)}$ to the metal nano-powder M in the auxiliary alloy material with a core-shell structure is in the range of 1:1 to 1:20.

10. The method of preparing a sintered NdFeB magnet according to claim 6, wherein a weight ratio of the rare earth alloy $R_xH_{(100-x)}$ to the metal nano-powder M in the auxiliary alloy material with a core-shell structure is in the range of 1:1 to 1:20.

11. The method of preparing a sintered NdFeB magnet according to claim 1, wherein in step S3 a weight ratio of the auxiliary alloy material to the NdFeB powder is in the range of 1:20 to 1:1000.

12. The method of preparing a sintered NdFeB magnet according to claim 2, wherein in step S3 a weight ratio of the auxiliary alloy material to the NdFeB powder is in the range of 1:20 to 1:1000.

13. The method of preparing a sintered NdFeB magnet according to claim 6, wherein in step S3 a weight ratio of the auxiliary alloy material to the NdFeB powder is in the range of 1:20 to 1:1000.

14. The method of preparing a sintered NdFeB magnet according to claim 1, wherein a sintering temperature in step S4 is 950 to 1100° C. and a sintering, time in step S4 is 6 to 12 h.

15. The method of preparing a sintered NdFeB magnet according to claim 1, wherein the annealing treatment in step S4 includes a primary annealing treatment and a secondary annealing treatment, wherein the primary annealing treatment is performed at a temperature the range of 800 to 900° C. for 3 to 15 h, and wherein the secondary annealing treatment is performed at a temperature of 450 to 650° C. for 3 to 10 h.

16. The method of preparing a sintered NdFeB magnet according to claim 8, wherein the annealing treatment in step S4 includes a primary annealing treatment and a secondary annealing treatment, wherein the primary annealing treatment is performed at a temperature in the range of 800 to 900° C. for 3 to 15 h, and wherein the secondary annealing treatment is performed at a temperature of 450 to 650° C. for 3 to 10 h.

17. The method of preparing a sintered NdFeB magnet according to claim 11, wherein the annealing treatment in step S4 includes a primary annealing treatment and a secondary annealing treatment, wherein the primary annealing treatment is performed at a temperature in the range of 800 to 900° C. for 3 to 15 h, and wherein the secondary annealing treatment is performed at a temperature of 450 to 650° C. for 3 to 10 h.

* * * * *